US010109433B2

(12) United States Patent
Bleckmann et al.

(10) Patent No.: US 10,109,433 B2
(45) Date of Patent: Oct. 23, 2018

(54) ELECTRIC PUSH-BUTTON SWITCH, AND OPERATING ELEMENT HAVING AN ELECTRIC PUSH-BUTTON SWITCH

(71) Applicant: Leopold Kostal GmbH & Co. KG, Luedenscheid (DE)

(72) Inventors: Michael Bleckmann, Schwerte (DE); Tobias Hafner, Dortmund (DE)

(73) Assignee: Leopold Kostal GmbH & Co. KG, Luedenscheid (DE)

( * ) Notice: Subject to any disclaimer, the term of this patent is extended or adjusted under 35 U.S.C. 154(b) by 201 days.

(21) Appl. No.: 15/267,204

(22) Filed: Sep. 16, 2016

(65) Prior Publication Data

US 2017/0004932 A1 Jan. 5, 2017

Related U.S. Application Data

(63) Continuation of application No. PCT/EP2015/057249, filed on Apr. 1, 2015.

(30) Foreign Application Priority Data

Apr. 8, 2014 (DE) ..... 10 2014 005 123

(51) Int. Cl.
*H01H 3/12* (2006.01)
*H01H 13/14* (2006.01)
(Continued)

(52) U.S. Cl.
CPC ..... *H01H 3/122* (2013.01); *H01H 13/14* (2013.01); *H01H 13/26* (2013.01); *H01H 13/52* (2013.01);
(Continued)

(58) Field of Classification Search
CPC ..... H01H 3/122; H01H 13/14; H01H 13/26
(Continued)

(56) References Cited

U.S. PATENT DOCUMENTS 5,032,698 A * 7/1991 Satoh ..... H01H 3/12 200/341
5,712,459 A * 1/1998 Ziegler ..... H01H 3/122 200/17 R
(Continued)

FOREIGN PATENT DOCUMENTS

DE 3643927 A1 7/1988
DE 1425154 C1 10/1995
(Continued)

OTHER PUBLICATIONS

The International Bureau of WIPO, International Preliminary Report on Patentability for International Application No. PCT/EP2015/057249 dated Oct. 20, 2016.
(Continued)

*Primary Examiner* — Renee Luebke
*Assistant Examiner* — Iman Malakooti
(74) *Attorney, Agent, or Firm* — Brooks Kushman P.C.

(57) ABSTRACT

An electric pushbutton switch includes a pushbutton, a rocker, and a housing. The pushbutton has a substantially rectangular actuating surface. The pushbutton is received within the housing and is displaceable connected to the housing. The pushbutton displaces with respect to the housing by way of a pressure actuation onto the actuating surface, thus triggering an electrical switching element. The rocker is box-shaped and is arranged within the housing beneath the pushbutton body and is at least partially encompassed by the pushbutton. The rocker is mounted on an inner longitudinally extending wall of the housing by a pivot bearing. By actuating the actuating surface, the rocker pivots about the pivot bearing while supporting the pushbutton along the longitudinal extension of the pushbutton.

16 Claims, 3 Drawing Sheets

(51) Int. Cl.
*H01H 13/26* (2006.01)
*H01H 13/52* (2006.01)

(52) U.S. Cl.
CPC . *H01H 2221/044* (2013.01); *H01H 2221/058* (2013.01); *H01H 2227/022* (2013.01); *H01H 2227/026* (2013.01); *H01H 2239/006* (2013.01); *H01H 2239/074* (2013.01)

(58) Field of Classification Search
USPC ..... 200/344, 341
See application file for complete search history.

(56) References Cited

U.S. PATENT DOCUMENTS

| | | | | |
|---|---|---|---|---|
| 5,803,238 | A | 9/1998 | Roza | |
| 2013/0292235 | A1* | 11/2013 | Baum | H01H 13/06 200/302.2 |
| 2013/0327624 | A1* | 12/2013 | Volpato | H01H 13/56 200/529 |
| 2014/0034468 | A1* | 2/2014 | Krumpelman | H01H 3/122 200/5 A |

FOREIGN PATENT DOCUMENTS

| | | | |
|---|---|---|---|
| DE | 19757929 | A1 | 7/1999 |
| DE | 102010029642 | B3 | 9/2011 |
| DE | 102011013180 | A1 | 9/2012 |
| DE | 102012024384 | A1 | 7/2014 |
| EP | 07491336 | A2 | 12/1996 |
| JP | 2005259587 | A | 9/2005 |
| JP | 2008198521 | A | 8/2008 |

OTHER PUBLICATIONS

European Patent Office, International Search Report for the International Application No. PCT/EP2015/057249 dated Aug. 31, 2015.
German Patent and Trademark Office, German Search Report for the corresponding German Patent Application No. DE 10 2014 005 123.4 dated Nov. 21, 2014.

* cited by examiner

ELECTRIC PUSH-BUTTON SWITCH, AND OPERATING ELEMENT HAVING AN ELECTRIC PUSH-BUTTON SWITCH

CROSS-REFERENCE TO RELATED APPLICATIONS

This application is a continuation of International Application No. PCT/EP2015/057249, published in German, with an International filing date of Apr. 1, 2015, which claims priority to DE 10 2014 005 123.4, filed Apr. 8, 2014; the disclosures of which are hereby incorporated in their entirety by reference herein.

TECHNICAL FIELD

The present invention relates to an electric pushbutton switch having a pushbutton and a housing in which the pushbutton is displaceable against the housing by pressure actuation on an actuating surface of the pushbutton thereby triggering an electrical switching element. The present invention further relates to an operating element having the pushbutton switch.

BACKGROUND

A problem with existing guides made of guide ribs and guide grooves for a pushbutton is the tendency for the pushbutton to jam when the lengths of the guides are short. Tilting of a rectangular-shaped pushbutton having a long length and a narrow width that is supported within an opening of a housing may result in jamming of the pushbutton in the housing. This is particularly the case when the lengths of linear guides formed on the narrow width sides of the pushbutton are short in comparison to the length of the pushbutton.

Regardless of possible jamming, tilting of the pushbutton also results in an altered actuation feel due to changed actuating paths and actuating forces. Based on experience, unacceptably high friction and high actuating forces result when the length of a linear guide formed from a guide rib and a guide groove is shorter than one-half of the overall length of the pushbutton. Designing a comfortably actuatable pushbutton having a relatively large longitudinal extension (i.e., a large overall length) thus requires a relatively long length linear guide. This results in a relatively large installation height of the pushbutton switch. In many cases, however, a large installation height is undesirable.

Space bars on computer keyboards form pushbuttons having a large longitudinal extension in comparison to the actuating path. For such a pushbutton, eccentrically supported wire clips are often used which stabilize the pushbutton. A disadvantage of this approach is the relatively low bending and torsional rigidity of such wires and the long paths in the force action chain. Both properties result in tilting of the pushbutton at higher actuating forces.

SUMMARY

An object is a pushbutton switch having a pushbutton which is long in comparison to the installation height and which does not have a tendency to tilt or jam.

Another object is for the pushbutton of the pushbutton switch to have uniform switch haptics that are independent of the selected actuation site.

Another object is an operating element having the pushbutton switch.

In carrying out at least one of the above and/or other objects, an electric pushbutton switch is provided. The pushbutton switch includes a housing, a pushbutton, an electrical switching element, and a rocker. The housing and the rocker are rectangular, box-shaped. The pushbutton has a rectangular actuating surface and a pair of longitudinally extending side walls and a pair of laterally extending side walls extending perpendicular from the actuating surface. The pushbutton is arranged within the housing and is displaceable relative to the housing upon a pressure actuation onto the actuating surface. The rocker is arranged within the housing and at least partially encompassed by the pushbutton. The rocker is supported on an inner surface of a longitudinally extending side wall of the housing by at least one pivot bearing to be pivotable relative to the housing. The electrical switching element is adjacent to the rocker. In response to the pushbutton being displaced relative to the housing upon a pressure actuation onto the actuating surface, the rocker pivots relative to the housing thus triggering the electrical switching element and while the rocker pivots the rocker supports the pushbutton over a longitudinal extension of the pushbutton thereby preventing the pushbutton from tilting.

The laterally extending side walls of the pushbutton have guide ribs (or guide grooves) which cooperate respectively with guide grooves (or guide ribs) of laterally extending side walls of the housing to form respective linear guides. The pushbutton is displaceable connected to the housing via the linear guides such that the pushbutton displaces along the linear guides relative to the housing upon a pressure actuation onto the actuating surface.

The rocker may have a contact edge. In this case, the pushbutton contacts the rocker along the contact edge; and the contact edge of the rocker is configured such that when the rocker pivots the rocker supports via the contact edge the pushbutton over the longitudinal extension of the pushbutton thereby preventing the pushbutton from tilting.

The rocker may have at least two contact sites situated along a connecting line in parallel to a direction of the longitudinal extension of the pushbutton. In this case, the pushbutton contacts the rocker along the contact sites; and the contact sites of the rocker are configured such that when the rocker pivots the rocker supports via the contact sites the pushbutton over the longitudinal extension of the pushbutton thereby preventing the pushbutton from tilting.

The rocker has two contact sites situated on the upper longitudinal edge of the rocker facing away from the at least one pivot bearing and along a connecting line in parallel to a direction of the longitudinal extension of the pushbutton. In this case, the pushbutton contacts the rocker along the contact sites; and the contact sites of the rocker are configured such that when the rocker pivots the rocker supports via the contact sites the pushbutton over the longitudinal extension of the pushbutton thereby preventing the pushbutton from tilting.

The contact sites may be elevated protrusions.

The pushbutton may further include one of a positioning groove and a positioning rib on one of the longitudinally extending side walls of the pushbutton.

An embodiment provides an electric pushbutton switch. The pushbutton switch includes a pushbutton, a rocker, and a housing. The pushbutton includes a pushbutton body and a pushbutton cap or cover. The pushbutton cap and the pushbutton body are connected to assemble the pushbutton. The pushbutton has an overall box-like shape with a substantially rectangular actuating surface. The pushbutton cap forms the actuating surface. The housing is rectangular, box-shaped. The pushbutton is received within the housing. The pushbutton is displaceable connected to the housing to be displaceable with respect to (or against) the housing. The pushbutton displaces with respect to the housing by way of a pressure actuation onto the actuating surface of the pushbutton cap, thus triggering an electrical switching element.

The rocker is box-shaped. The rocker is arranged within the housing beneath the pushbutton body and is at least partially encompassed by the pushbutton body. The rocker is mounted on an inner longitudinally extending wall of the housing by a pivot bearing(s). By actuating the actuating surface of the pushbutton cap, the rocker pivots about the pivot bearing while supporting the pushbutton almost along the entire longitudinal extension of the pushbutton.

Another embodiment provides an operating element having an electric pushbutton switch such as the pushbutton switch.

In embodiments, an electric pushbutton switch includes a pushbutton, a rocker, and a housing. The rocker is situated beneath the pushbutton and is supported on an inner longitudinal wall of the housing by at least one pivot bearing. The rocker is pivotable about the at least one pivot bearing by actuating the pushbutton with the pushbutton being supported over substantially its entire longitudinal extension.

In an embodiment, the pushbutton formed by the pushbutton cap and the pushbutton body has a rectangular, semi box-like shape with the pushbutton cap forming a rectangular actuating surface. The rectangular shape of the pushbutton includes two long length sides and two short width sides. The overall or entire length or the pushbutton (i.e., the longitudinal extension of the pushbutton) is the length of a length side.

The rocker is box-shaped having a length and a width that substantially correspond to the dimensions of the pushbutton. The rocker can therefore support the pushbutton over substantially the entire length of the pushbutton. The feature "substantially" (or "approximately") results from the rocker being situated beneath the pushbutton body and overlapped by the two side walls of the pushbutton body. The two sides walls of the pushbutton body respectively correspond to the two short width sides of the pushbutton. The side walls of the pushbutton body which overlap the rocker include guide ribs (or, alternately, guide grooves). The longitudinal extension of the rocker is therefore shorter than the longitudinal extension of the pushbutton by the magnitude of the thickness of the two side walls of the pushbutton body. The support for the pushbutton does not result in a possible rotation axis in the transverse direction perpendicular to the longitudinal extension of the pushbutton, about which the pushbutton could tilt.

For support, the pushbutton body contacts the rocker either along a narrow contact edge in parallel to the direction of the longitudinal extension of the pushbutton or at two or more contact sites situated along a line in parallel to the direction of the longitudinal extension of the pushbutton. The length of the contact edge or the distance between the farthest apart contact sites preferably is the same or at least substantially the same as the length of the rocker. The contact sites between the rocker and the pushbutton body are therefore situated at the outermost ends of a longitudinal edge of the rocker. As a result, the pushbutton is supported over virtually its entire length by the rocker and tilting of the pushbutton is reliably prevented.

In an embodiment, each pivot bearing pivotably supporting the rocker to the housing is provided by a respective film hinge.

In an embodiment, an operating element includes the pushbutton switch as a control element having multiple capacitive sensors. Sensor fields of the capacitive sensors are situated along the surface of the pushbutton cap. A capacitive sensor field is lightly touched to preselect a switching function, which is confirmed and thus triggered by pressing the pushbutton. An actuating pressure is usually applied to the partial surface of the pushbutton cap which was previously touched for selecting the function. Since different actuation sites may be selected, depending on the situation, it is advantageous that the same movement of the pushbutton, and thus the same switch feel, always results regardless of the actuation site.

BRIEF DESCRIPTION OF THE DRAWINGS

Functional principles and exemplary embodiments of an electric pushbutton switch and an operating element having an electric pushbutton switch are explained in greater detail below with reference to the drawings, which show the following.

DETAILED DESCRIPTION

Detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
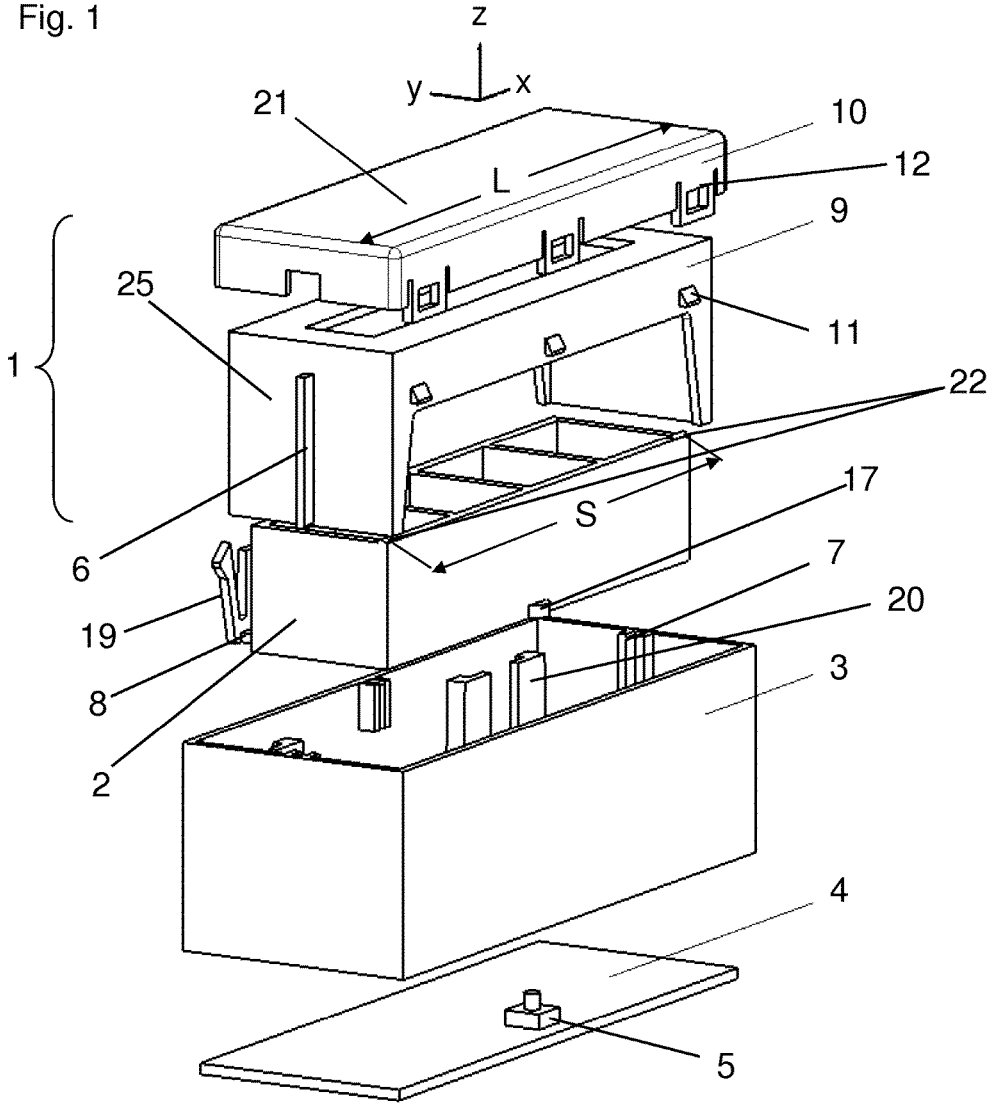
FIG. 1 illustrates an exploded view of an electric pushbutton switch in accordance with an exemplary embodiment.

Referring now to FIG. 1, an electric pushbutton switch in accordance with an exemplary embodiment will be described. The pushbutton switch includes a pushbutton 1, a rocker 2, and a housing 3. Pushbutton 1 includes a pushbutton body 9 and a pushbutton cap 10. Pushbutton cap 10 is a cover for pushbutton 1 and includes an actuating surface 21. Actuating surface 21 of pushbutton cap 10 is substantially rectangular shaped. Pushbutton body 9 and pushbutton cap 10 are connected to one another via interlocking elements to form the assembled pushbutton 1. The interlocking elements include locking tabs 11 on pushbutton body 9 and locking latches 12 on pushbutton cap 10.

Pushbutton body 9 is semi box-like and has a relatively long longitudinal extension (i.e., length) and a relatively short lateral extension (i.e., width). Pushbutton body 9 extends through an opening of housing 3 and is received within housing 3. Pushbutton body 9 is displaceable with respect to housing 3.

Pushbutton body 9 has side walls 25 on its width sides. Side walls 25 include integrally molded guide ribs 6. Housing 3 includes guide grooves 7. Guide grooves 7 are molded onto inner walls of housing 3.

Figure 2:
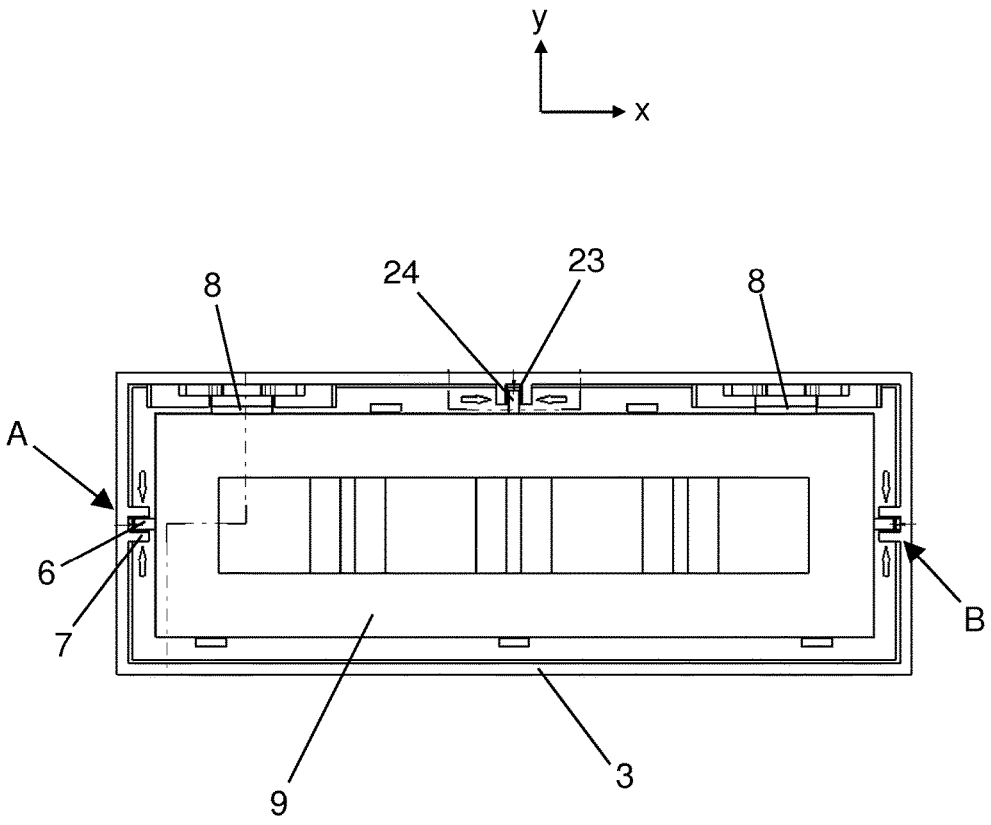
FIG. 2 illustrates a top view of a pushbutton body of a pushbutton of the pushbutton switch within a housing of the pushbutton switch.

Referring now to FIG. 2, with continual reference to FIG. 1, a top view of pushbutton body 9 within housing 3 is shown. Guide ribs 6 of pushbutton body 9 and guide grooves 7 of housing 3 interact with one another to form respective linear guides for pushbutton 1. In particular, a first guide rib 6 of a first side wall 25 of pushbutton body 9 is received within a first guide groove 7 of housing 3 to form a linear guide A at the first side wall 25 of pushbutton body 9; and a second guide rib 6 of a second side wall 25 of pushbutton body 9 is received within a second guide groove 7 of housing 3 to form a linear guide B at the second side wall 25 of pushbutton body 9.

Referring now back to FIG. 1, with continual reference to FIG. 2, pushbutton body 9 is vertically displaceable along linear guides A and B in the direction of the z axis relative to housing 3. Pushbutton 9 is displaceable with respect to housing 3 by way of a pressure actuation onto actuating surface 21 of pushbutton cap 10, thus triggering an electrical switching element 5.

Rocker 2 is substantially box-shaped. Rocker 2 is slightly shorter in length and narrower in width than pushbutton body 9. Rocker 2 is arranged beneath pushbutton body 9 and is arranged within housing 3. Side walls 25 of pushbutton body 9 overlap rocker 2. In this installed state, rocker 2 is mounted on an inner longitudinally extending wall (i.e., on one of the two length walls (sides) of housing 3). Rocker 2 is mounted on the inner surface of the inner longitudinally extending wall of housing 3 by two pivot bearings 8. Rocker 2 is pivotable about pivot bearings 8.

Rocker 2 includes two film hinges 19 molded on the outer surface of a length wall of rocker 2. This length wall of rocker 2 faces the inner longitudinally extending wall of housing 3. Housing 3 includes two guide tracks 20 mounted on the inner surface of the inner longitudinally extending wall of housing 3. Film hinges 19 of rocker 2 are respectively pushed into guide tracks 20 of housing 3. Film hinges 19 of rocker 2 fastened in this way to guide tracks 20 of housing 3 respectively form the two pivot bearings 8, about which rocker 2 is pivotable. As such, each pivot bearing 8 is formed by a respective film hinge 19 of rocker 2 and a respective guide track 20 of housing 3.

The bottom side of pushbutton body 9 rests against rocker 2 at two or more contact sites 22. Contact sites 22 are situated on a single connecting line. If more than two contact sites 22 are provided, then all of the contact sites are situated on a single connecting line so that the connecting lines of the contact sites do not span an area between pushbutton 1 and rocker 2. Namely, if pushbutton body 9 rested flatly against rocker 2, then pushbutton 1 could not bring about pivoting of rocker 2. This is because in this case pushbutton 1 itself would have to undergo a tilting movement which is not desirable and is precluded by linear guides A and B.

Contact sites 22 are illustrated by two protrusions molded onto the top side of rocker 2. These two protrusions 22, unlike what is shown in FIG. 1, may be widened enough along the direction of longitudinal extension of pushbutton 1 so that overall they form a single narrow, elevated contact edge extending over the entire length of rocker 2, and thus also over approximately the entire length L of pushbutton 1.

Alternatively, contact sites 22, or the contact edge (not shown), may be mounted on the bottom side of pushbutton body 9. Contact sites 22 are thus fixedly molded on, either to rocker 2 or to pushbutton 1, and rest lightly against the respective counterpart 1, 2, which allows pivoting of rocker 2 when pushbutton 1 undergoes a displacement movement along linear guides A and B.

In FIG. 1, the protrusions which form contact sites 22 are situated at the outer ends of an upper longitudinal edge of rocker 2. The transmission of force to rocker 2 thus always takes place between contact sites 22 when actuating surface 21 of pushbutton cap 10 is pressed, regardless of the selected actuation site. This thus precludes tilting of pushbutton 1 about one of protrusions 22. The distance S between contact sites 22 that are farthest apart, or the length of the contact edge, corresponds exactly to the length of rocker 2.

The front longitudinal wall of rocker 2 includes a projection 17. Projection 17 is supported on a switching element 5 and triggers switching element 5 when rocker 2 pivots. Switching element 5, for example, a switch dome of a silicone safety mat, a snap disk, a short-stroke pushbutton, etc., allows pressure actuation over a relatively short actuating path. Switching element 5 either has an elastic design or has a spring and thus generates a restoring force which acts on rocker 2 under the action of pressure.

Switching element 5 is fastened to a printed circuit board (PCB) 4 via which the electrical connection of switching element 5 is established. Triggering of switching element 5 by an action of pressure closes or opens an electrical contact.

FIG. 2 depicts the guides of pushbutton 1 within housing 3. A top view of pushbutton body 9 situated within housing 3 is shown. Apparent at the two narrow sides of pushbutton body 9 and of housing 3 are the linear guides A and B. In each case, linear guides A and B are made up of a guide rib 6 on a narrow side of pushbutton body 9 and a guide groove 7 on an inner side of housing 3. Conversely, guide ribs may be situated on housing 3 and guide grooves may be situated on pushbutton body 9.

With regard to the coordinate axes x, y, z depicted in the FIGS., linear guides A and B position the location of pushbutton 1 with respect to the y axis, and at the same time prevent pushbutton 1 from twisting about the x axis and about the vertical axis z. A positioning groove 23 molded onto a longitudinal side of housing 3 and a positioning rib 24 molded onto pushbutton body 9 which engages with positioning groove 23, also prevent displacements of pushbutton body 9 along the x axis.

Due to the solid rocker 2 pivotably supported on housing 3, pushbutton 1 is supported over approximately its entire length in each actuation phase. Rocker 2 tilts about its pivot bearing(s) 8 a small distance about the x axis and at the same time moves downwardly in the z direction, but does not rotate about the y axis. As such, pushbutton 1 supported on rocker 2 likewise is not able to pivot about the y axis. During an actuation, pushbutton 1 thus moves downwardly in the z direction precisely in parallel to the walls of housing 3, regardless of the particular location at which the actuating pressure acts on actuating surface 21 of pushbutton 1.

Figure 3:
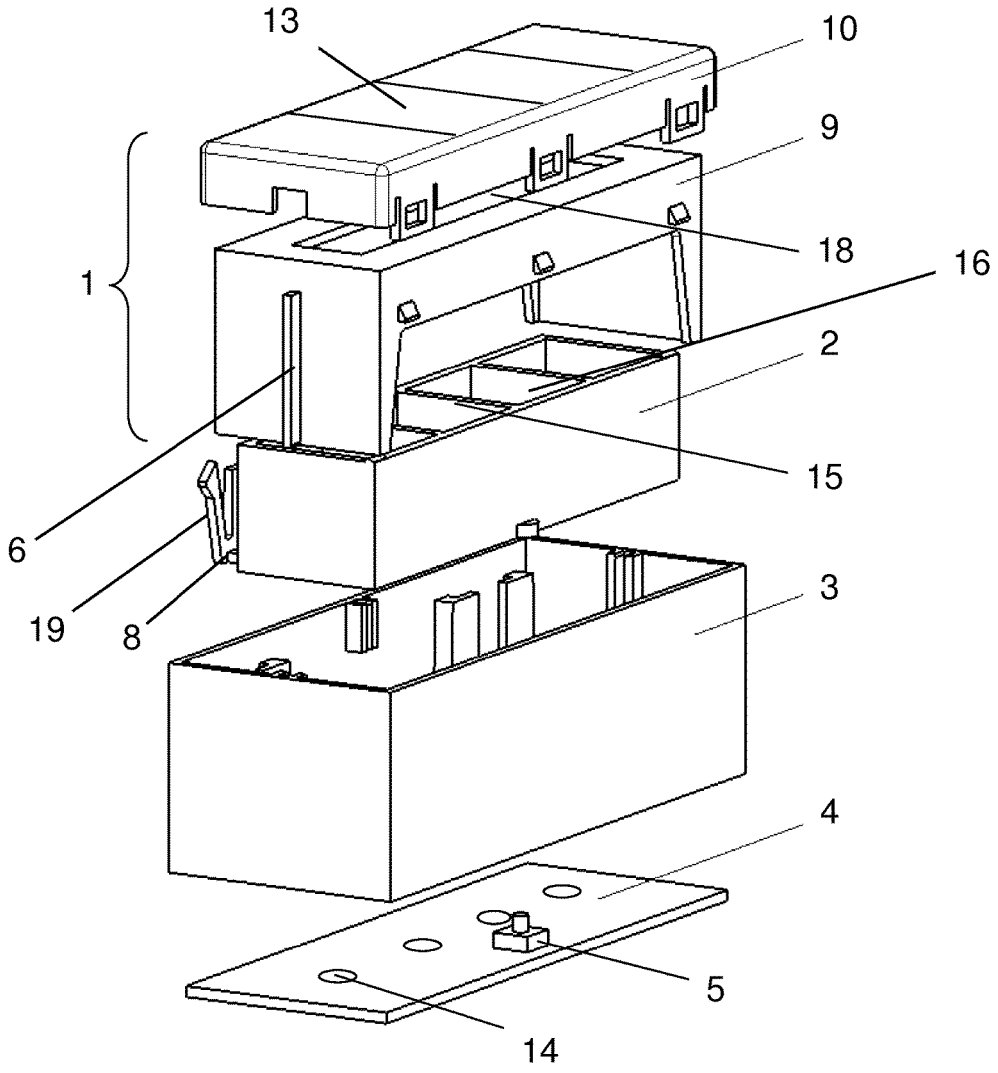
FIG. 3 illustrates an exploded view of an operating element having an electric pushbutton switch in accordance with another exemplary embodiment.

Referring now to FIG. 3, with continual reference to FIGS. 1 and 2, an exploded view of an operating element having an electric pushbutton switch in accordance with another exemplary embodiment is shown. The operating element, which may be used in motor vehicles, for example, has multiple (e.g., four) capacitive sensor fields 13 on pushbutton cap 10. In order to form capacitive sensors (not shown), sensor fields may be situated on a flexible circuit carrier. For example, the flexible circuit carrier may be a thin conductive foil. The conductive foil is bordered between pushbutton cap 10 and pushbutton body 9. The conductive foil may additionally bear the components of an evaluation electronics system, or may be connected to an evaluation electronics system present at some other location, for example on PCB 4.

Touching one of the sensor fields 13 allows one of multiple functions to be preselected. This is then confirmed and thus triggered by pressure actuation of pushbutton 1. Pushbutton 1 is generally pressed at the location at which sensor field 13 associated with the function selected at that moment is also present. In order to obtain an actuation feel when pushbutton 1 is pressed, which is independent of the particular function selection, it is desirable for the actuation haptics to be independent from the actuation site of pushbutton 1. This is achieved by the design according to the exemplary embodiments of the pushbutton switch.

Sensor fields 13 situated on pushbutton cap 10 may have an illuminable design for displaying the function that is preselected or triggered by actuating pushbutton 1. For this purpose, four lighting elements (e.g., LEDs) 14, corresponding to the amount of sensor fields 13 provided on pushbutton 1, are situated on PCB 4. A recess 18 is introduced into the top side of pushbutton body 9 in the longitudinal direction to allow the light from lighting elements 14 to reach pushbutton cap 10. Rocker 2 has multiple dividing walls 15. Dividing walls 15 form multiple chambers 16 within rocker 2 which are open at the top and bottom. Dividing walls 15 take over the function of a diaphragm in order to limit the light from lighting elements 14 in each case to the area of individual associated sensor fields 13. Dividing walls 15 also provide reinforcement, and thus a relatively more stable design, of rocker 2.

LIST OF REFERENCE NUMERALS

1 Pushbutton
2 Rocker
3 Housing
4 Circuit carrier (printed circuit board)
5 Switching element
6 Guide ribs
7 Guide grooves
8 Pivot bearing
9 Pushbutton body
10 Pushbutton cap
11 Locking tabs
12 Locking latches
13 Sensor fields
14 Lighting elements
15 Dividing walls
16 Chambers
17 Projection
18 Recess
19 Film hinge
20 Guide tracks
21 Actuating surface
22 Contact sites (protrusions)
23 Positioning groove
24 Positioning rib
25 Side walls
A, B Linear guides
L Longitudinal extension
S Distance
x, y, z (Coordinate) axes While exemplary embodiments are described above, it is not intended that these embodiments describe all possible forms of the present invention. Rather, the words used in the specification are words of description rather than limitation, and it is understood that various changes may be made without departing from the spirit and scope of the present invention. Additionally, the features of various implementing embodiments may be combined to form further embodiments of the present invention.

What is claimed is:

1. An electric pushbutton switch comprising:

a housing having a rectangular, box-shape;

a pushbutton including an actuating surface having a rectangular shape, the pushbutton further including a pair of longitudinally extending side walls and a pair of shorter length, laterally extending side walls extending perpendicular from the actuating surface, the pushbutton arranged within the housing and is connected to the housing to be linearly displaceable relative to the housing while being pivotably constrained;

a rocker having a rectangular, box-shape, the rocker arranged within the housing and at least partially encompassed by the pushbutton, the rocker supported on an inner surface of a longitudinally extending side wall of the housing by at least one pivot bearing to be pivotable relative to the housing, the rocker further having an elevated contact edge;

an electrical switching element adjacent to the rocker;

the pushbutton supported on the rocker and contacting the elevated contact edge of the rocker to rest uneven against the rocker along a longitudinal extension of the pushbutton such that pivoting of the rocker relative to the housing is enabled without the pushbutton having to pivot when the pushbutton is linearly displaced relative to the housing; and wherein the rocker, in response to the pushbutton being linearly displaced relative to the housing upon a pressure actuation onto the actuating surface, pivots relative to the housing thus triggering the electrical switching element.

2. The electric pushbutton switch of claim 1 wherein:

the rocker has a length and a width that are smaller than but substantially correspond respectively to a length of the pair of longitudinally extending side walls of the pushbutton and a length of the pair of laterally extending side walls of the pushbutton; and the housing has a length and a width that are greater than but substantially correspond respectively to the length of the pair of longitudinally extending side walls of the pushbutton and the length of the pair of laterally extending side walls of the pushbutton.

3. The electric pushbutton switch of claim 1 wherein:

the pair of laterally extending side walls of the pushbutton have guide ribs which cooperate respectively with guide grooves of laterally extending side walls of the housing to form linear guides, the pushbutton being displaceable connected to the housing via the linear guides such that the pushbutton displaces along the linear guides relative to the housing upon a pressure actuation onto the actuating surface.

4. The electric pushbutton switch of claim 1 wherein:

the pair of laterally extending side walls of the pushbutton have guide grooves which cooperate respectively with guide ribs of laterally extending side walls of the housing to form linear guides, the pushbutton being displaceable connected to the housing via the linear guides such that the pushbutton displaces along the linear guides relative to the housing upon a pressure actuation onto the actuating surface.

5. The electric pushbutton switch of claim 1 wherein:

the pair of laterally extending side walls of the pushbutton overlap the rocker.

6. The electric pushbutton switch of claim 1 wherein:

the elevated contact edge of the rocker has at least two elevated contact sites situated along a connecting line in parallel to a direction of the longitudinal extension of the pushbutton.

7. The electric pushbutton switch of claim 1 wherein:

the elevated contact edge of the rocker has two contact sites situated on an upper longitudinal edge of the rocker facing away from the at least one pivot bearing and along a connecting line in parallel to a direction of the longitudinal extension of the pushbutton.

8. The electric pushbutton switch of claim 1 wherein:

the pushbutton further includes one of a positioning groove and a positioning rib on one of the longitudinally extending side walls of the pushbutton.

9. The electric pushbutton switch of claim 1 wherein:

each pivot bearing has at least one film hinge.

10. The electric pushbutton switch of claim 1 wherein:

the electrical switching element is a switch dome, a snap disk, or a short-stroke pushbutton.

11. The electric pushbutton switch of claim 1 wherein:

the pushbutton includes a pushbutton cover and a pushbutton body which are connected together via locking elements to form the pushbutton, the pushbutton cover including the actuating surface and the pushbutton body including the pair of longitudinally extending side walls and the pair of laterally extending side walls extending perpendicular from the actuating surface.

12. The electric pushbutton switch of claim 11 wherein:

the pushbutton cover includes a plurality of capacitive sensor fields arranged as part of the actuating surface.

13. The electric pushbutton switch of claim 12 wherein:

a switching function is preselected by touching one of the capacitive sensor fields and triggered by pressing the actuating surface.

14. An electric pushbutton switch comprising:

a housing;

a pushbutton including an actuating surface having a rectangular shape, the pushbutton further including a pair of longitudinally extending side walls and a pair of shorter length, laterally extending side walls extending perpendicular from the actuating surface, the pushbutton being arranged within the housing and being connected to the housing to be linearly displaceable relative to the housing while being pivotably constrained;

a rocker having a box-shape, the rocker arranged within the housing and at least partially encompassed by the pushbutton, the rocker being supported on an inner surface of a longitudinally extending side wall of the housing by at least one pivot bearing to be pivotable relative to the housing, the rocker further having an elevated contact edge;

wherein the rocker has a length and a width that are smaller than but substantially correspond respectively to a length of the pair of longitudinally extending side walls of the pushbutton and a length of the pair of laterally extending side walls of the pushbutton;

an electrical switching element adjacent to the rocker;

the pushbutton supported on the rocker and contacting the elevated contact edge of the rocker to rest uneven against the rocker along a longitudinal extension of the pushbutton such that pivoting of the rocker relative to the housing is enabled without the pushbutton having to pivot when the pushbutton is linearly displaced relative to the housing; and wherein the rocker, in response to the pushbutton being linearly displaced relative to the housing upon a pressure actuation onto the actuating surface, pivots relative to the housing thus triggering the electrical switching element.

15. The electric pushbutton switch of claim 14 wherein:

the pair of laterally extending side walls of the pushbutton have guide ribs which cooperate respectively with guide grooves of laterally extending side walls of the housing to form linear guides, the pushbutton displaces along the linear guides relative to the housing upon a pressure actuation onto the actuating surface.

16. The electric pushbutton switch of claim 15 wherein:

the elevated contact edge of the rocker has at least two elevated protrusions situated along a connecting line in parallel to a direction of the longitudinal extension of the pushbutton.

* * * * *